US006629853B2

(12) United States Patent
Whiteman, Jr.

(10) Patent No.: US 6,629,853 B2
(45) Date of Patent: Oct. 7, 2003

(54) SELF-ALIGNING POWER CONNECTOR SYSTEM

(75) Inventor: Robert N. Whiteman, Jr., Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 132 days.

(21) Appl. No.: 09/859,866

(22) Filed: May 17, 2001

(65) Prior Publication Data

US 2002/0173190 A1 Nov. 21, 2002

(51) Int. Cl.[7] ..... H01R 13/64
(52) U.S. Cl. ..... 439/246; 439/628
(58) Field of Search ..... 439/246, 249–252, 439/628, 821, 843–845, 849

(56) References Cited

U.S. PATENT DOCUMENTS 4,653,826 A 3/1987 Burgess et al.
4,917,616 A 4/1990 Demler, Jr. et al. ..... 439/101
5,342,211 A 8/1994 Broeksteeg ..... 439/108
5,415,571 A * 5/1995 Lutsch ..... 439/843
6,186,810 B1 * 2/2001 Barnabe et al. ..... 439/252
6,394,829 B1 * 5/2002 Patterson et al. ..... 439/252

* cited by examiner

*Primary Examiner*—Khiem Nguyen
(74) *Attorney, Agent, or Firm*—Baker & Daniels

(57) ABSTRACT

An electrical connector assembly is described for the interconnection of a daughter card to a backplane. The backplane connector includes a housing and a contact assembly including a contact portion solderable to a circuit trace of a printed circuit board. The contact assembly in the backplane connector further includes an interposer contact portion, which is movable relative to the main contact portion to laterally align itself with a tab terminal in a mating and complementary daughter board connector.

28 Claims, 12 Drawing Sheets

SELF-ALIGNING POWER CONNECTOR SYSTEM

BACKGROUND OF THE INVENTION

The invention relates to receptacle and plug style contacts for realigning themselves when the mating connectors are misaligned.

In back plane style connection systems, it is common to have a plurality of electrical connectors mounted to daughter cards, which are pluggable to connectors on a backplane. The daughter card connectors are generally right angle connectors whereas the backplane connectors upstand from the backplane. This disposes the daughter cards for connection to the backplane in a stacked relation such that the daughter cards are aligned one-by-one in an array of daughter card assemblies. One example of such a connection system is shown in U.S. Pat. No. 5,342,211, incorporated herein by reference.

In such assemblies, it is also common to have both signal and power contacts. These contacts are positioned in a high density array of contacts where hundreds of signal contacts are positioned in the same connector, or connector assembly. Normally, the signal contacts carry low power and thus the contacts can have a small cross-sectional area, even to the point of being flexible along their beam length. This allows for self-alignment of the arrays of contacts in the case where the contacts are laterally misaligned when the daughter cards are being connected to their respective backplane connector. However, in the case of the power contacts, the mating contacts are normally of a larger cross-sectional area. For example, heavy tabs with a mating receptacle are often used, where the tabs and receptacles are comprised of thick gauge material to handle the high power, yet are inflexible to misalignment. This causes a drastic increase in the mating force between the two connectors to an already high mating force connection system, and can also cause damage to the power connection system, if the two connectors are forced together with the power contacts misaligned.

It is therefore an object of the invention to overcome the above-mentioned problems, and particularly to overcome the shortcoming of the misalignment.

BRIEF SUMMARY OF THE INVENTION

The objects of the invention have been accomplished by providing an electrical contact for electrical connection with a mating contact, the electrical contact having a base contact portion and an interposer contact portion. The interposer contact portion being electrically connected to said base contact portion and laterally movable to align itself with the mating contact.

In the preferred embodiment of the invention, the interposer contact portion comprises first contact surfaces for electrical engagement with the base contact portion, and second contact surfaces for mating engagement with the mating contact. Also preferably, the first and second contact surfaces are formed normal relative to each other. The interposer contact portion is defined by a U-shaped portion having first and second plate portions connected by a bight portion, where the first contact portions are formed internally of the first and second plate portions, at the end opposite the bight portion, and the second contact surfaces are formed transversely through the bight portion.

The interposer contact portion can take on a plurality of configurations. The interposer contact portion could be defined by an L-shaped portion having bifurcated contact portions extending in opposite legs of the L-shaped portion and extending in opposite directions. The interposer contact portion could also be defined by a blade-shaped contact having outer contact surfaces for mating contact with the mating contact portion, and a transverse slot to receive the main contact portion. Alternatively, the interposer contact could have a circular cross-section, in which case the interposer contact could be cylindrical or have a parabolic cross-section.

In the preferred embodiment, the main contact portion is defined by a blade portion having a transverse receiving slot for receiving the mating contact portion. In this configuration, the interposer contact portion could be defined by arcuate portions having surfaces in contact with the main contact portion and portions spanning the transverse receiving slot. The portions spanning the transverse receiving slot are positioned on opposite sides of the blade portion.

In another embodiment of the invention, the invention embodies an electrical connector for the interconnection of conductors, and for mating connection with a mating contact. The connector comprises an insulating housing having a main terminal receiving cavity, a main terminal portion received in the main terminal receiving cavity and an interposer contact portion electrically connected to the main terminal portion. The interposer contact portion is movable to align itself with the mating contact if misaligned.

In the preferred embodiment of the invention, the interposer contact portion comprises first contact surfaces for electrical engagement with the main terminal portion, and second contact surfaces for mating engagement with the mating contact. Preferably, the housing includes an interposer receiving section having the interposer contact portion positioned therein. The interposer receiving section allows for lateral movement of the interposer contact portion within the interposer receiving section.

In the preferred embodiment of the invention, the first and second contact surfaces are formed normal relative to each other. The interposer contact portion can be defined as a U-shaped portion having first and second plate portions connected by a bight portion, where the first contact portions are formed internally of the first and second plate portions, and the second contact surfaces are formed transversely through the bight portion.

Other alternative configurations are also possible, for example, the interposer contact portion can be defined by an L-shaped portion having bifurcated contact portions extending in opposite legs and extending in opposite directions. The interposer contact portion could also be defined by a blade-shaped contact having outer contact surfaces for mating contact with the mating contact portion, and a transverse slot to receive the main contact portion.

In other embodiments of the invention, the main contact portion is defined by a blade portion having a transverse receiving slot for receiving the mating contact portion. In this configuration, the interposer contact portion is defined by arcuate portions having surfaces in contact with the main contact portion and portions spanning the transverse receiving slot. The portions spanning the transverse receiving slot are positioned on opposite sides of the blade portion.

In the preferred embodiment of the invention, the connector comprises a plurality of terminal assemblies comprised of main terminal portions and interposer portions. The terminal assemblies would be profiled for use with power (either AC or DC) and would further comprise a plurality of signal contacts. The housing is defined as a receptacle, with the power and signal contacts aligned in a side-by-side array.

DETAILED DESCRIPTION OF THE INVENTION

Figure 1:
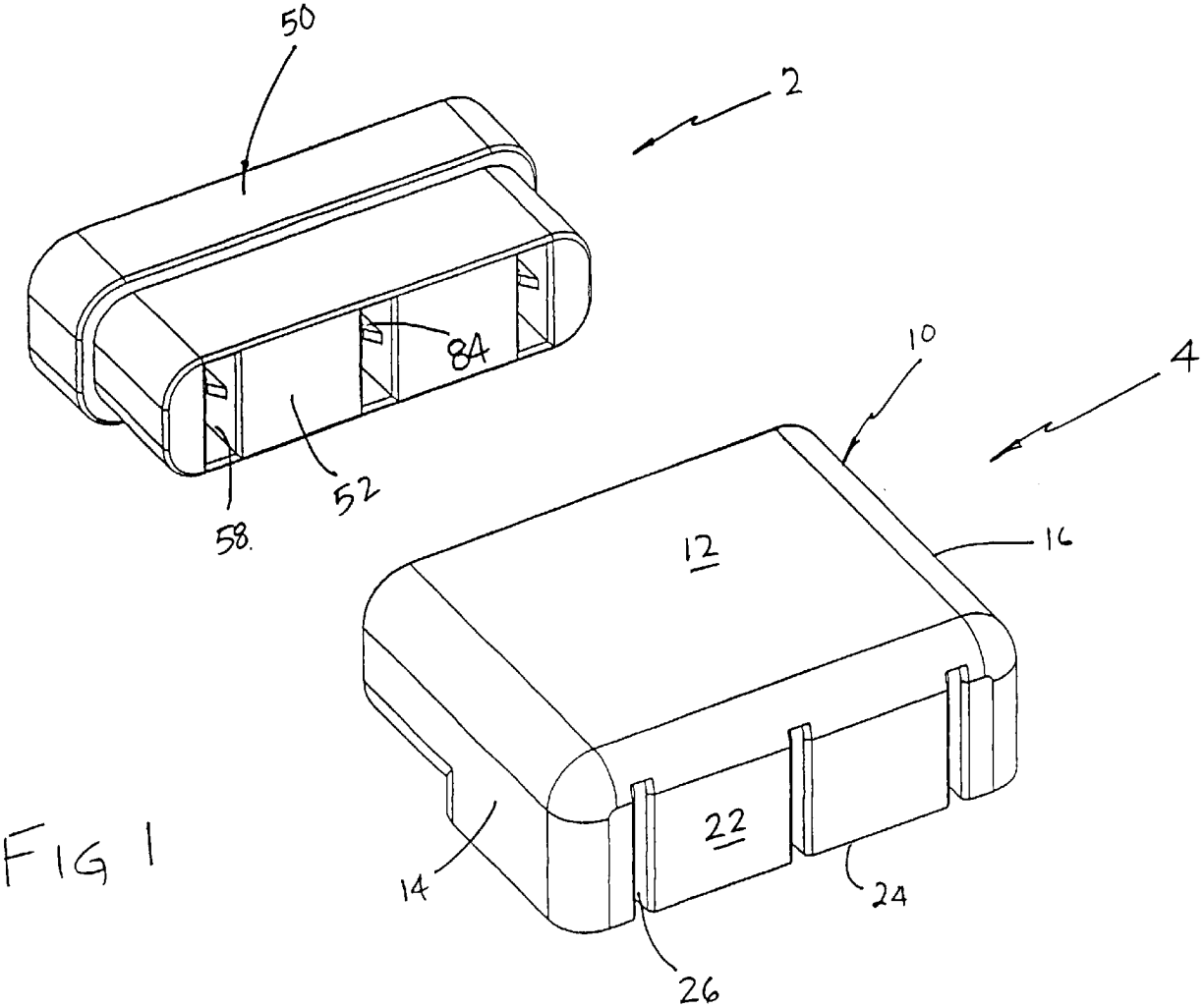
FIG. 1 shows a perspective view of the daughter card and backplane connectors poised for interconnection.
Figure 2:
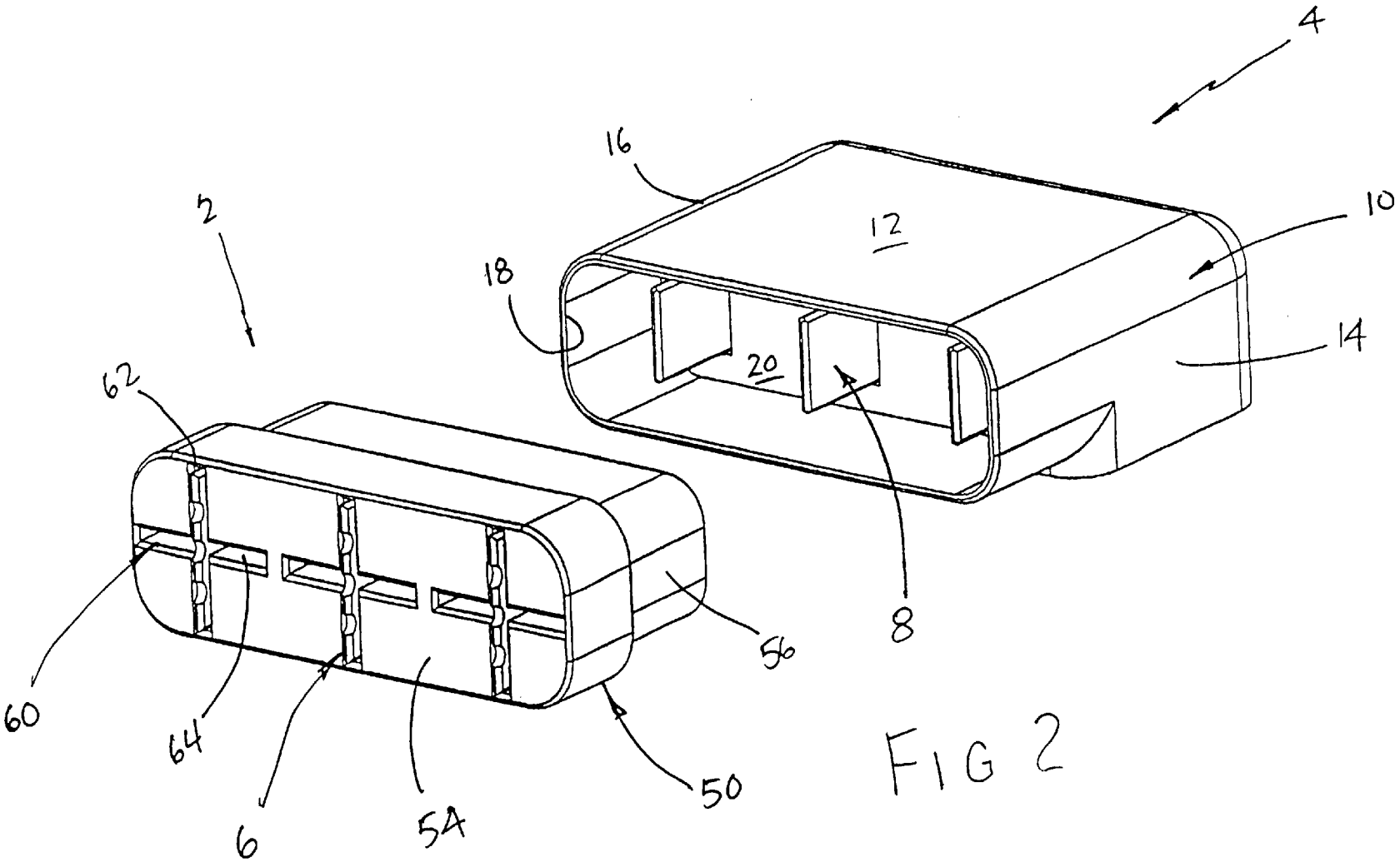
FIG. 2 shows a different perspective view of the connectors of FIG. 1.

With reference to FIGS. 1–4, the invention will be described in a somewhat diagrammatical form of connection system, with a further description of alternative contact systems referencing FIGS. 5–17. With reference first to FIG. 1, a backplane connector is shown generally at 2 for electrical interconnection of a daughter card connector 4. As shown in FIG. 2, the backplane connector 2 includes contact assemblies 6, preferably for surface mount solderability to the backplane, whereas the daughter card connector includes contact assemblies 8, which also are preferably surface mount contacts and are interconnectable with contact assemblies 6 of the backplane connector 2.

With reference now to FIGS. 1 and 2, the daughter card connector 4 will be described in greater detail. The daughter card connector 4 includes a housing 10 comprised of a top wall 12, side walls 14, 16, a shroud portion 18 forming a recess to inner wall 20 and to surround the contact members 8. With reference to FIG. 1, the housing 10 further includes rear wall 22 and daughter card mounting surface 24 together with terminal receiving slots 26 intersecting with both walls 22, 24, as well as extending through wall 20 to allow the passage of the contacts therethrough. It should be appreciated that housing 10 is profiled with the front face formed by the shroud 18 and the daughter card mounting surface 24 being formed at right angles to each other for the interconnection of the daughter card to the backplane.

Figure 3:
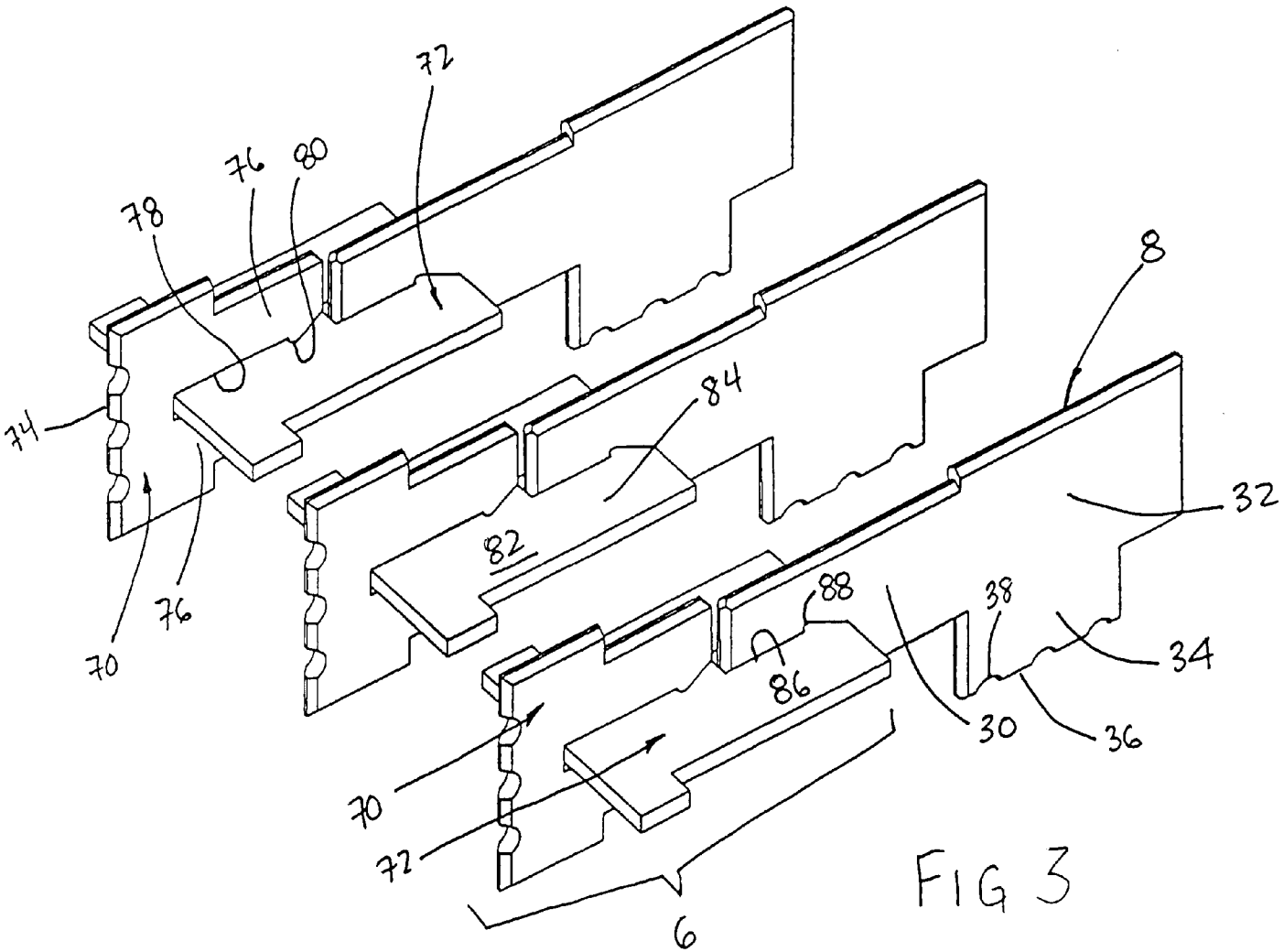
FIG. 3 shows a perspective view of the backplane and daughter card terminals in a fully aligned and fully mated condition.
Figure 4:
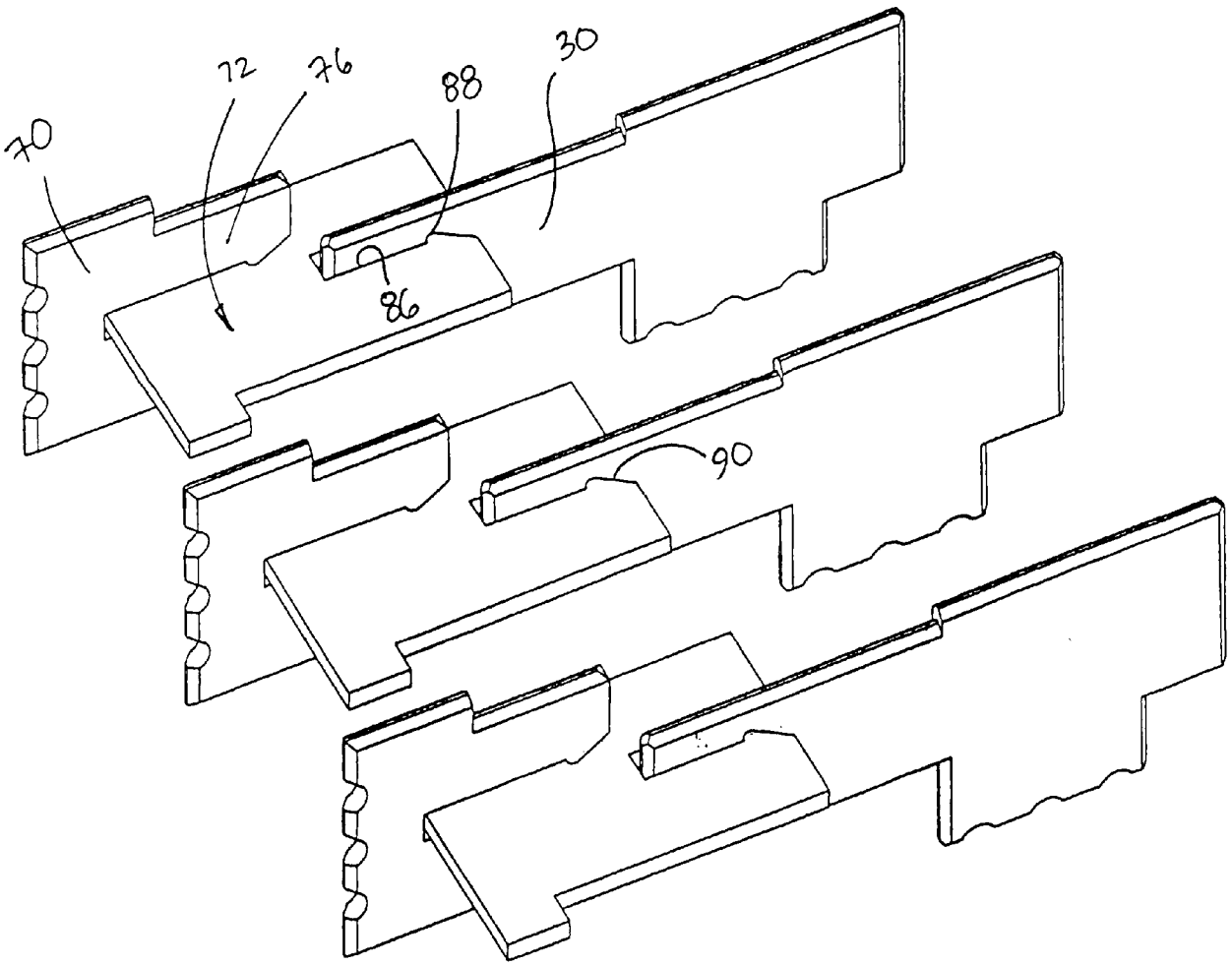
FIG. 4 shows the contacts of FIG. 3 when misaligned.

With reference now to FIG. 3, the contact member 8 will be described where the contact 8 includes an elongated tab portion 30 extending from a body portion 32 together with a printed circuit board contact portion 34 extending downwardly from the body portion 32. Once again, the tab portion 30 and a printed circuit board portion 34 extend at right angles with relation to each other. The printed circuit board portion 34 includes a contact edge 36 for interconnection to a printed circuit board contact pad with interrupting scallops 38 to allow for better soldering of the edge 36 to its associated contact pad. It should be appreciated by comparing FIGS. 1 and 3 that the tab portion 30 is receivable through the slot 26 to project outwardly from inner wall 20 to the configuration shown in FIG. 2. It should also be appreciated that the contact edge surface 36 of the printed circuit board contact 34 will extend below the surface 24 of housing 10.

With reference now to FIGS. 1 and 2, the backplane connector 2 will be described in greater detail. The backplane connector 2 includes a housing member 50 having a mating face 52 and a mounting face 54. The housing 50 also includes a reduced contour portion at 56, which is profiled to be received within the shroud portion 18. The housing 50 includes slots at 58 to access the contact portion 6 as will be described herein, which intersects with a cruciform shaped slot 60 through the mounting face 54 where slot 60 includes a transverse portion 62 and a lateral slot portion 64.

With reference now to FIG. 3, the contact assembly 6 is comprised of a main contact portion 70 and an interposer contact portion 72. The main contact portion 70 includes a printed circuit board surface mount portion 74 and dual cantilevered beam portions 76. The dual cantilevered beam portions form a receiving slot at 78 and further include contact portions 80 adjacent the front end. The interposer contact portion 72 includes a contact portion 82 and dual beam contact portions at 84. The dual beam portions 84 form slots 86 and contact portions at 88.

To assemble the backplane connector 2, the interposer contact portion 72 is disposed in the lateral slot portion 64 with the main contact portion 70 being positioned in the transverse slot 62. This forms an interconnection between the contact surfaces 80 of the main contact portion 70 and the contact area 82 of the interposer contact 72. This also disposes the contact arms 84 of the interposer contact within the slots 58 and adjacent to the mating face 52 as shown in FIG. 1.

It should be appreciated then that if the daughter card connector 4 were plugged into backplane connector 2, where the contacts are perfectly aligned, the interconnection would be similar to that depicted in FIG. 3. However, if the tab portions 30 are misaligned, the interposer contact portion 72 will slide relative to the contact beam portions 76 to align the tab portion 30 into the slot 86 and in contact with contact portions 88. It should also be appreciated that the contact beam portions 84 include lead-in surfaces 90 to assist in the alignment of the tab portion 30 with the slot 86 and to form the sliding contact between the interposer contact 72 and the main contact portion 70.

Figure 5:
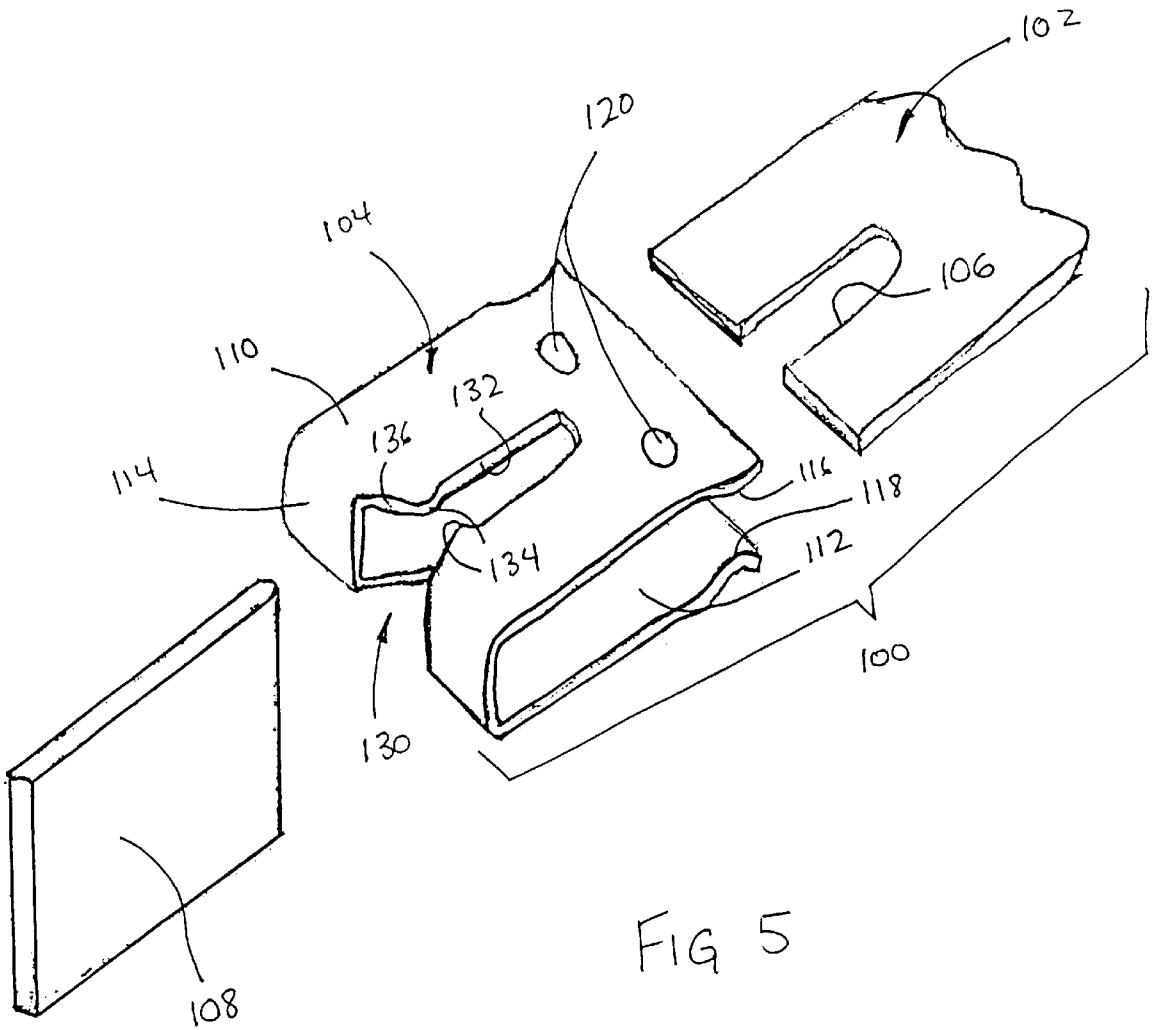
FIG. 5 is an alternative embodiment of the contact system of FIGS. 1–4.

With reference now to FIG. 5, an alternate embodiment of the contact assembly will be described. A contact assembly 100 is shown having a main contact portion 102 and an interposer contact potion 104. The main contact portion 102 includes a slotted section 106 for receiving the tab 108, as should be appreciated. The interposer contact portion 104 includes folded over plate portions 110, 112 interconnected by a bight portion 114. The plate portions 110 and 112 are constricted at their ends to form contact sections 116, 118 and pressure detents 120 can be added if desired.

A receptacle portion 130 is defined as a transverse slot through the bight portion 114, comprised of a slot portion 132, opposed contact portions 134, and lead-in sections at 136. It should be appreciated in this design, that the interposer contact 104 is slidably received over the main contact portion 102 such that the slot 132 is generally aligned with the slot 106. Tab 108 in the complementary connector is then inserted through the lead-in sections 136, and if misaligned, the interposer contact portion 104 can move laterally relative to the length of the main contact 102 to realign itself with the plane of the tab portion 108. During this sliding movement, the interposer maintains contact with the main contact portion through contact points 116, 118.

Figure 6:
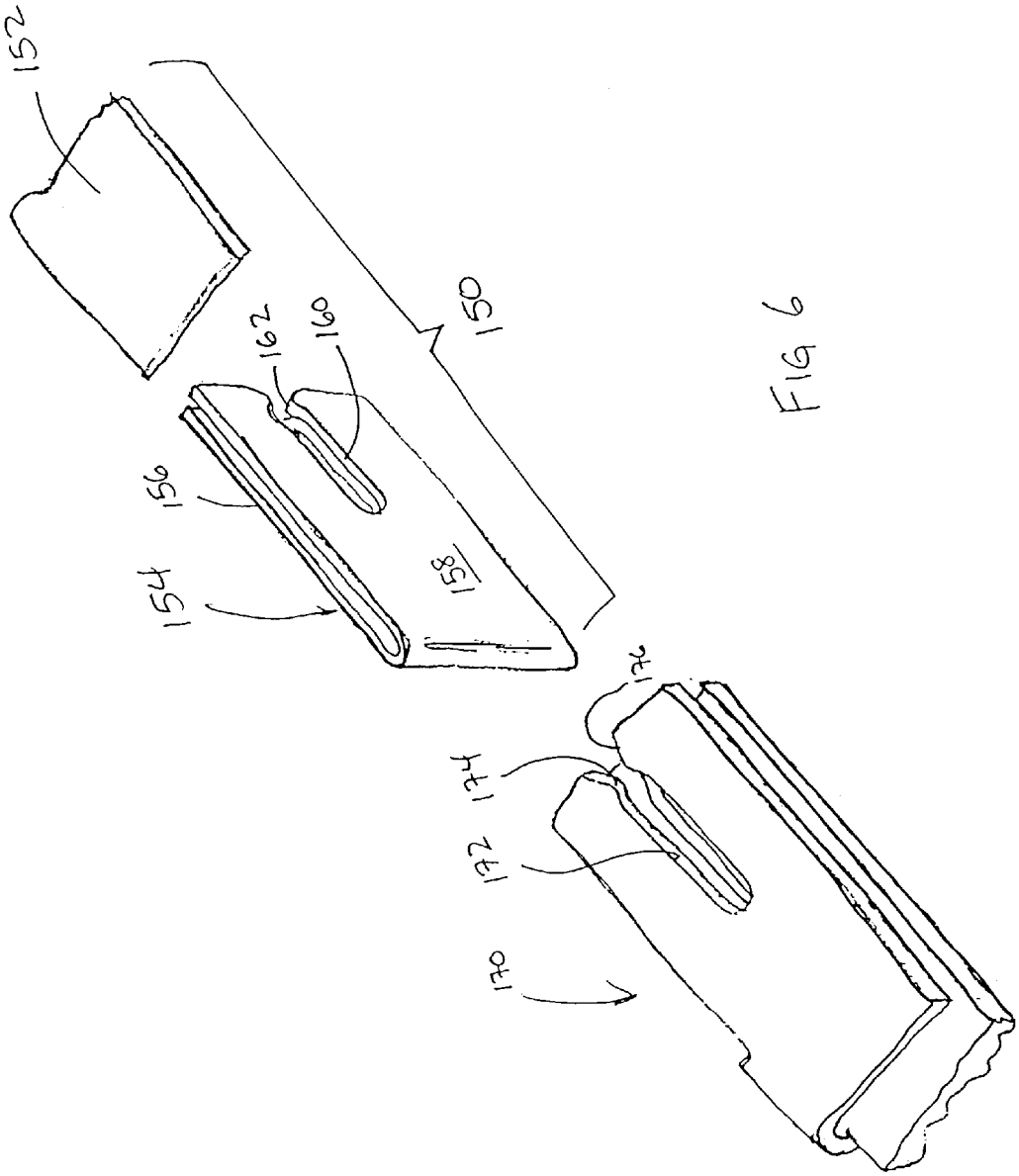
FIG. 6 is another alternative of the contact system of FIGS. 1–4.

With reference now to FIG. 6, a contact assembly 150 is shown including a main contact portion 152 and an interposer contact portion 154. In this embodiment, interposer contact portion 154 is comprised of two folded over plate portions 156, 158 where a slot 160 is formed through both plates and includes contact members 162. It should be understood that the contact portions 162 allow for receipt of the main contact portion 152, yet allow for lateral movement of the interposer contact 154 relative to the longitudinal axis of the main contact portion 152. The complementary contact is shown as 170 and includes a slotted receptacle portion 172 having contact portions 174. In this embodiment, the contact member 170 would move into engagement with interposer contact 154, and if misaligned, lead-in sections 176 would cause lateral movement of interposer contact portion 154 relative to the longitudinal length of the main contact portion 152 to laterally align contact members 170 and 154.

Figure 7:
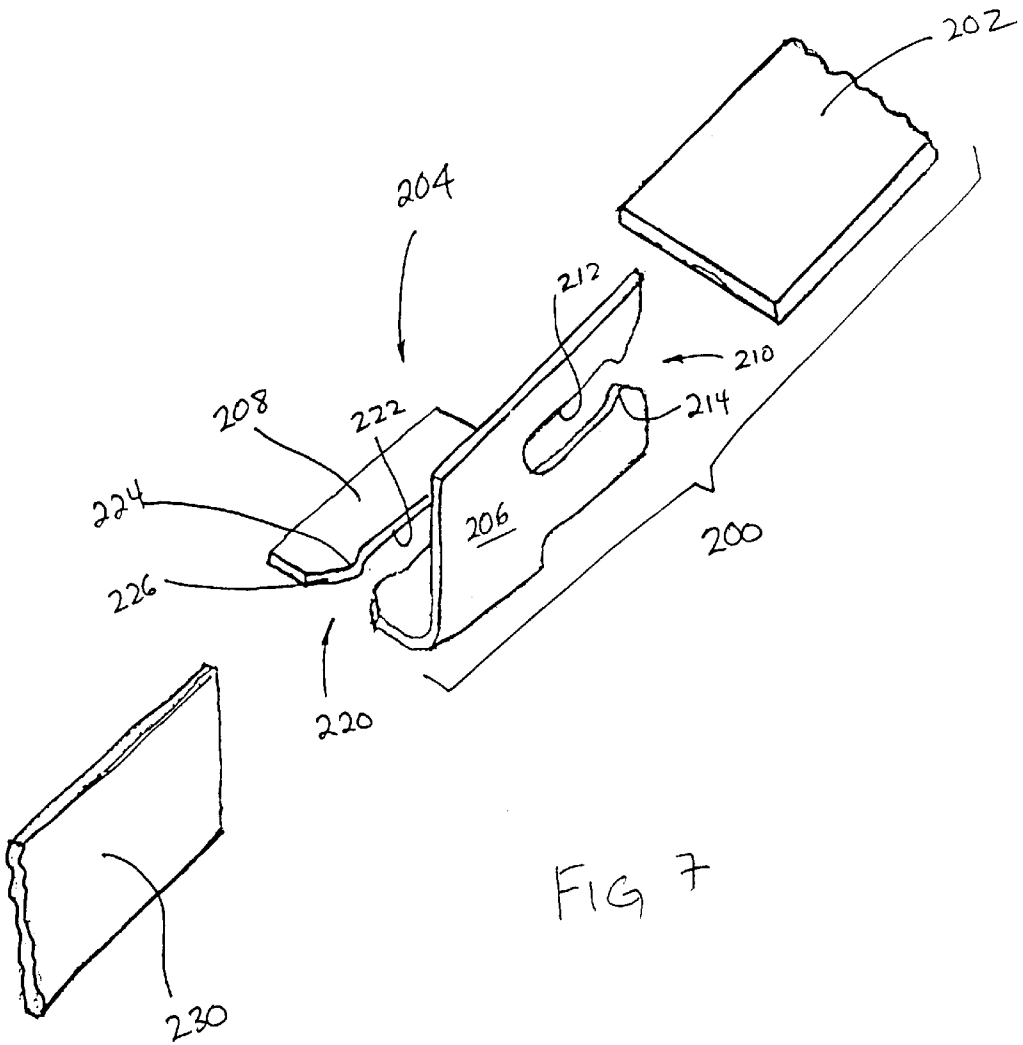
FIG. 7 is yet another embodiment of the contact system for the device of FIGS. 1–4.

With reference now to FIG. 7, a further embodiment of the contact assembly is shown at 200 including main contact portion 202 and interposer contact portion 204. Interposer contact 204 is L-shaped on the cross-section including leg portions 206 and 208. Leg portion 206 includes a receptacle contact 210 extending inwardly from a first end, including a slot 212 together with contact portions 214. Leg portion 208 includes a second receptacle portion 220 extending inwardly from the opposite end as that of receptacle portion 210, and includes a slotted portion 222, contact portion 224, and lead-in edges at 226. It should be appreciated that interposer contact portion 204 is assembled to the main contact portion 202, and that blade or tab terminal 230 is receivable into the receptacle portion 220, and if misaligned, interposer contact portion 204 is laterally moveable relative to the longitudinal length of main contact portion 202.

Figures 8, 9, 10:
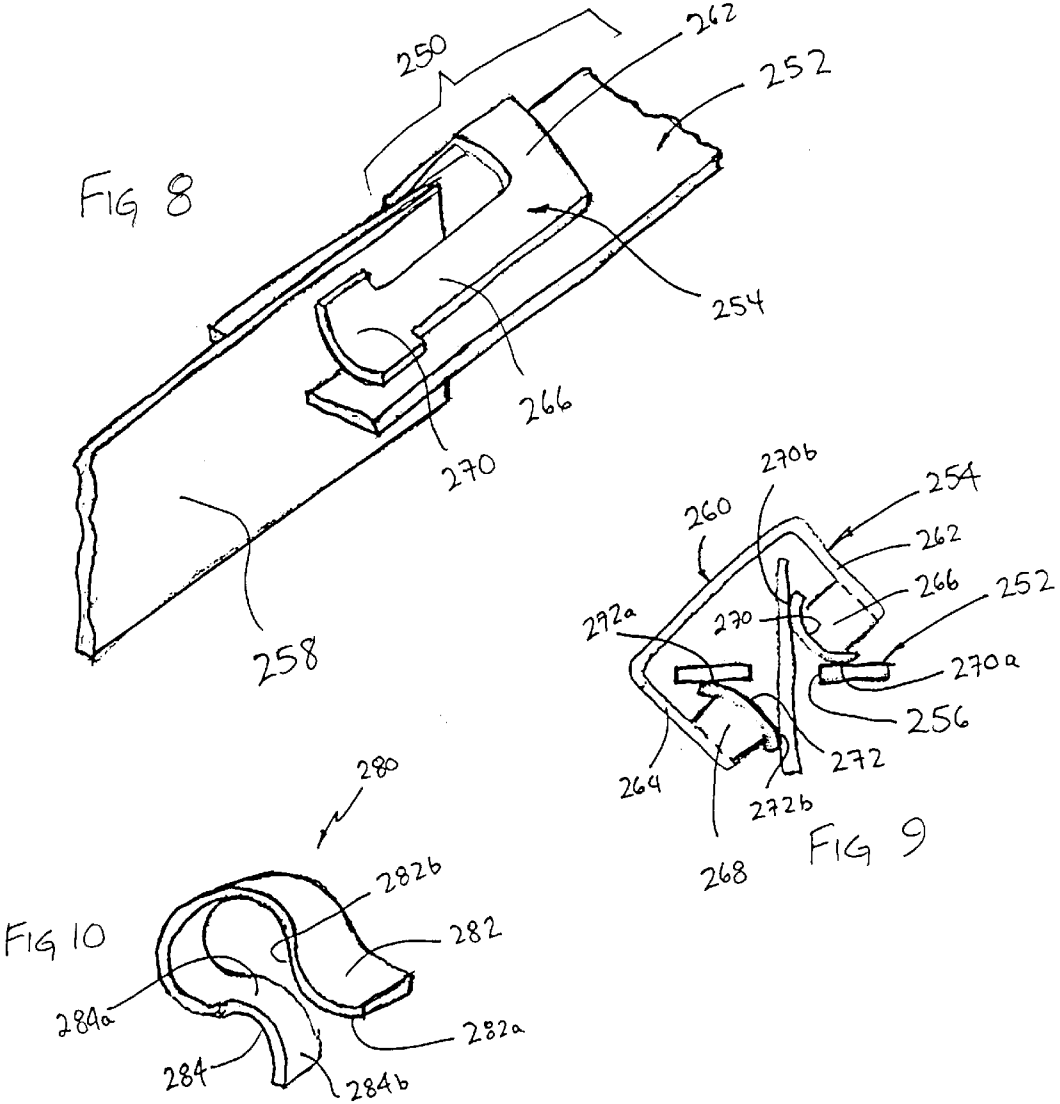
FIG. 8 is a further alternative embodiment of the contact system for the device of FIGS. 1–4.
FIG. 9 is an end view of the contact system of FIG. 8.
FIG. 10 is an alternative interposer contact to that of FIGS. 8 and 9.

With reference now to FIGS. 8 and 9, a further embodiment of the contact assembly is shown at 250 including a main contact portion 252 and an interposer contact portion 254. Main contact portion 252 includes a slotted section at 256 to receive tab portion 258 therein. Interposer contact portion 254 includes a rectangular box section 260 including arm portions 262 and 264, each having cantilevered beam sections 266, 268 extending therefrom. Each of the cantilevered beam sections 266, 268 include arcuate contact sections 270, 272 including contact surfaces 270*a*, 272*a*, to contact the main contact portion 252 and contact portions 270*b* and 272*b* for contacting with the tab portion 258.

FIG. 10 shows an alternate interposer contact portion 280 comprised of arcuate contact portions 282, 284 including contact surfaces 282*a*, 284*a* for contacting opposite sides of the main contact portion 252, and contact surfaces 282*b* and 284*b* for contacting opposite sides of the blade contact 258.

Figure 11:
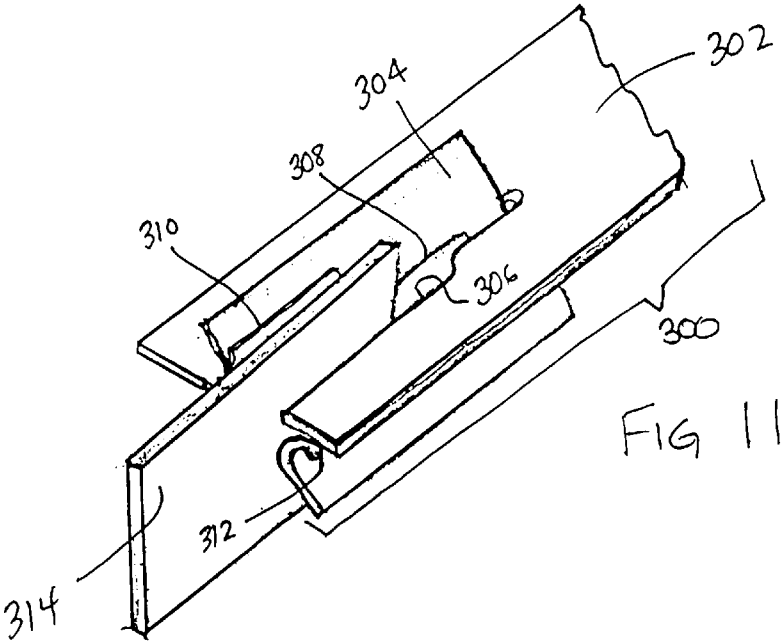
FIG. 11 is a further alternative embodiment.
Figure 12:
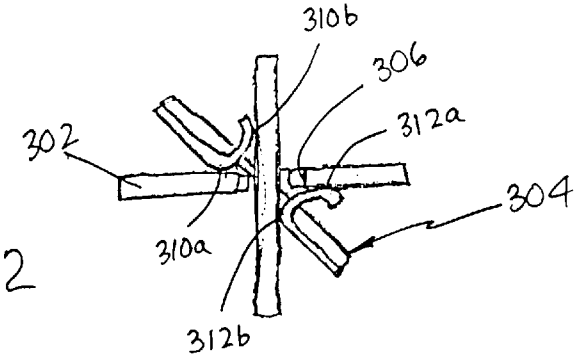
FIG. 12 is an end view of the contact embodiment of FIG. 11.

With reference now to FIGS. 11 and 12, another embodiment of contact assembly is shown at 300 including a main contact portion 302 and an interposer contact potion 304. In this embodiment, the main contact portion 302 includes a slotted section 306, and the interposer contact portion 304 includes a slotted portion 308 having integral contact portions 310, 312 connecting the main contact portion 302 and blade portion 314. As shown best in FIG. 12, contact portions 310, 312 include contact portions 310*a*, 312*a* for contacting opposite sides of the main contact portion 302, and contact portions 310*b* and 312*b* for contacting the blade portion 314. As should be understood, the interposer contact portion 304 can move laterally to accommodate the lateral movement necessary for mating with a blade 314 when misaligned.

Figure 13:
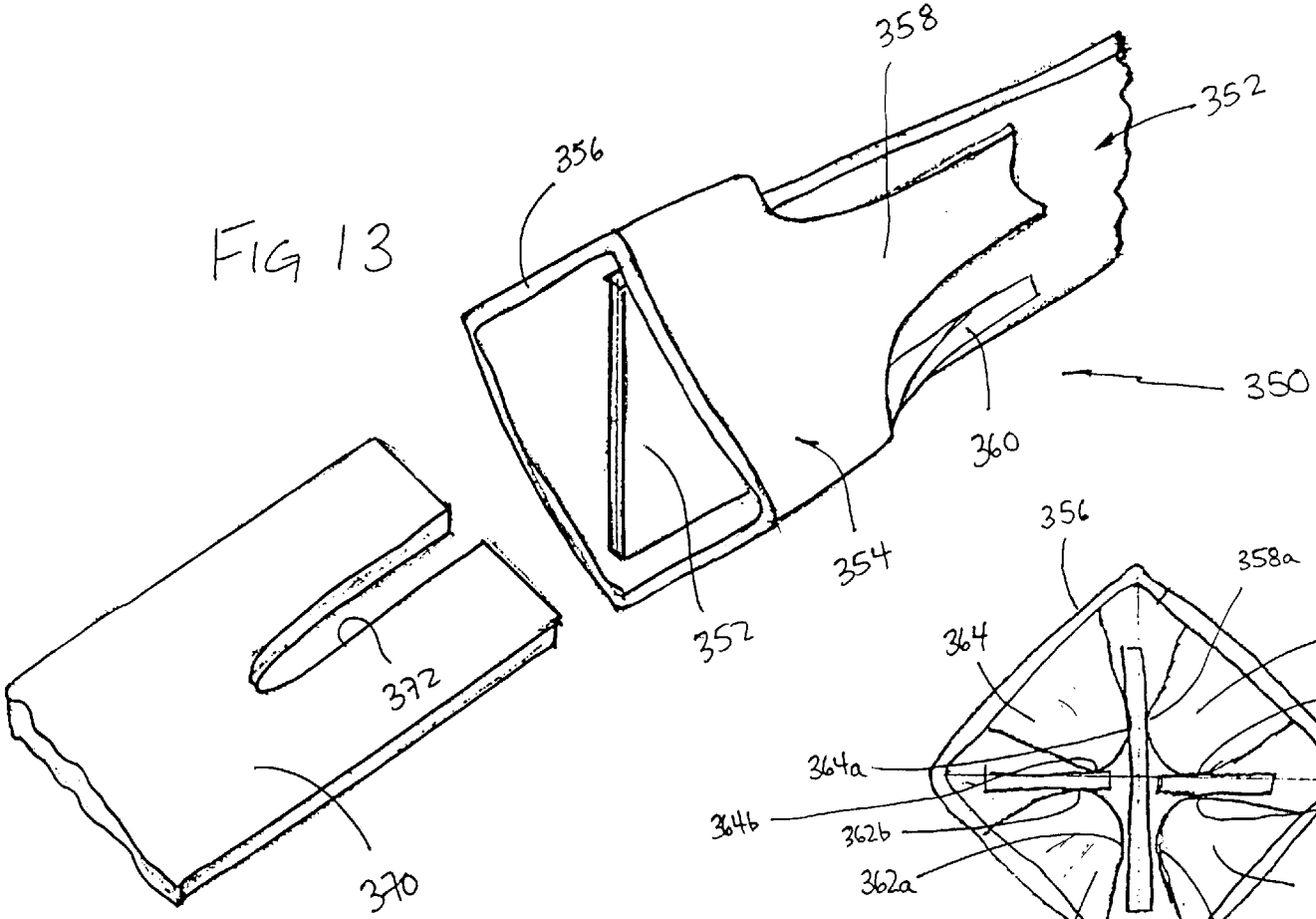
FIG. 13 is a further embodiment of the contact system.
Figure 14:
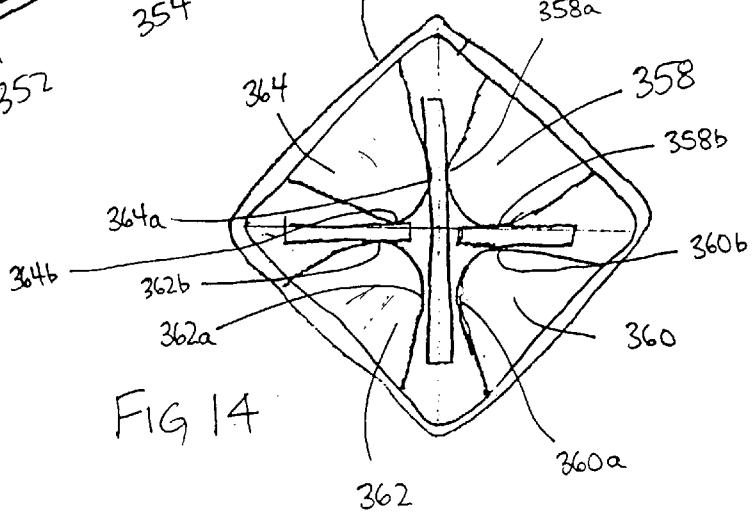
FIG. 14 is an end view of the contact system shown in FIG. 13.

With reference now to FIGS. 13 and 14, a further embodiment of the contact assembly is disclosed at 350 including a main contact portion 352 and an interposer portion 354. The interposer portion 354 includes a box shaped receptacle portion 356 having contact legs 358, 360, 362, and 364 extending rearwardly therefrom. The contact legs 358–364 include contact surfaces 358*a*, 360*a*, 362*a*, and 364*a* for contacting side surfaces of the main contact portion 352. The contact legs 358–364 further comprise contact surfaces 358*b*, 360*b*, 362*b*, and 364*b*. As shown in FIGS. 13 and 14, a mating contact portion 370 includes a slotted section 372 for receiving the main contact portion 352. At the same time, the contact portions 358*b*, 360*b*, 362*b*, and 364*b* will contact the slotted tab member 370 as best shown in FIG. 14.

Figures 15, 16:
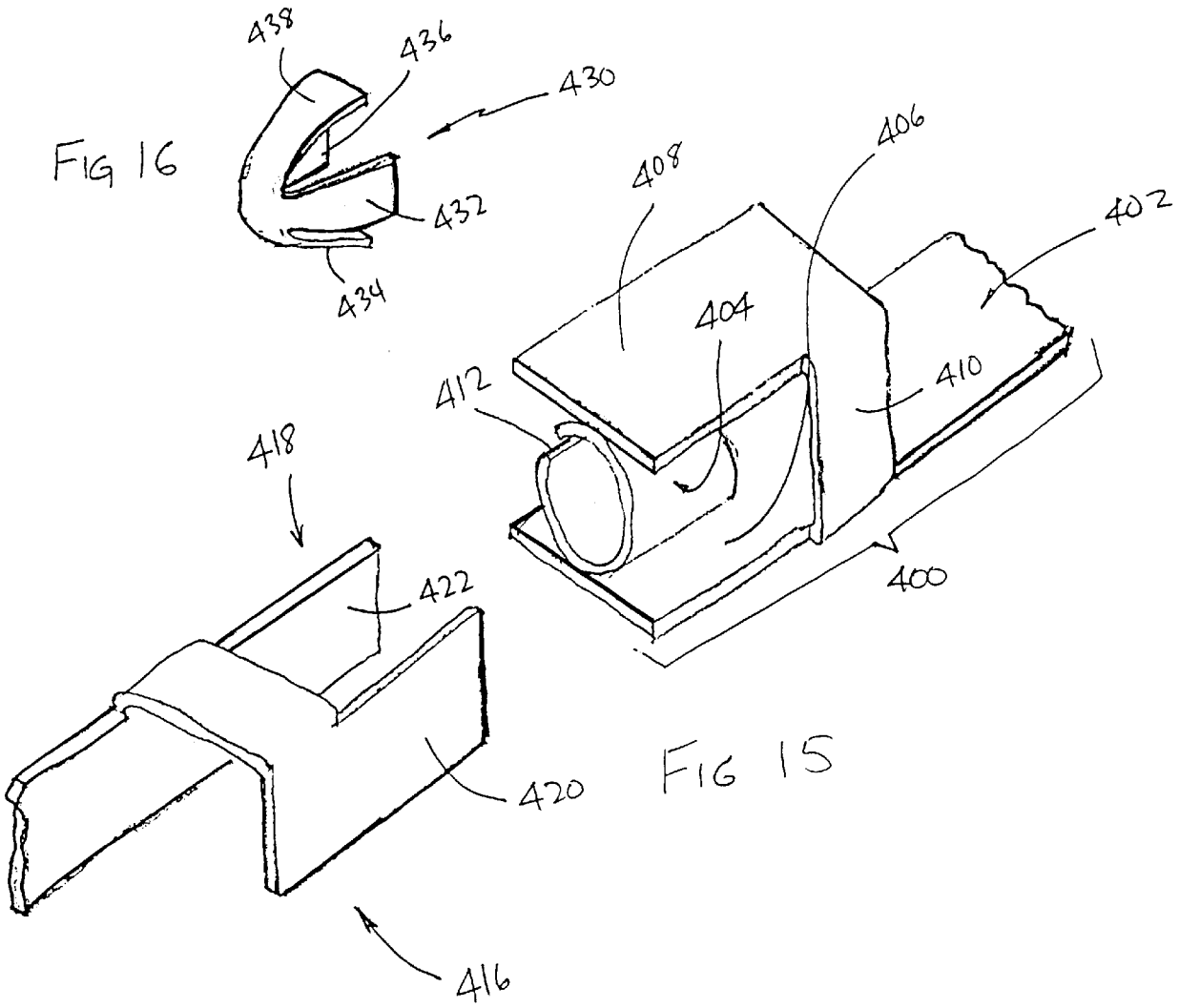
FIG. 15 is a further alternative embodiment of the contact system.
FIG. 16 is an alternative interposer contact for use with the contact system of FIG. 15.

With reference now to FIG. 15, another contact assembly is shown at 400 comprising a main contact portion 402 and an interposer contact portion 404. The main contact 402 includes a base plate section 406 having an opposed and upper wall portion 408 integrally connected by way of strap portion 410. As shown in FIG. 15, the interposer contact 404 would be a spring member having a seam at 412 so as to spring load the interposer contact 404 between the plate portion 408 and the base plate portion 406. A mating contact portion 416 can thereby include a receptacle contact 418 comprised of receptacle arms 420 and 422 for receiving therebetween, the interposer contact 404.

An alternate embodiment of interposer contact for use with the FIG. 15 embodiment is shown at 430, which is substantially parabolic in cross-section to include contact arms 432, 434, 436, and 438. It should be appreciated that the contact arms 434 and 438 can be placed intermediate with 406 and 408, while contact arms 420, 422 will contact side arms 432, 436. In the same manner as mentioned above, the interposer contact 430 is movable between walls 406, 408 to realign itself with the contact member 416 when misaligned.

Figure 17:
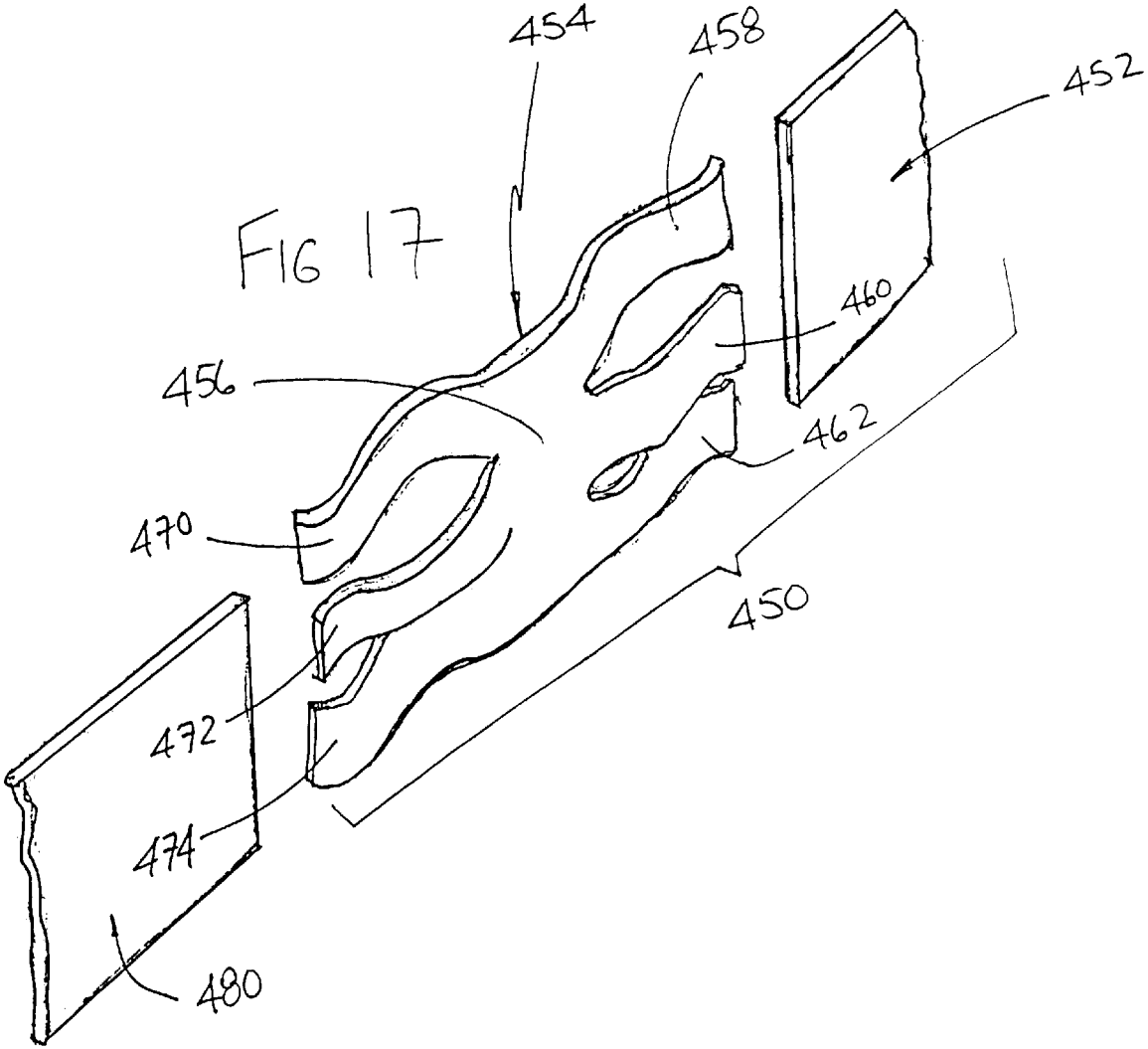
FIG. 17 is a further embodiment of the contact system.

With reference now to FIG. 17, a contact assembly 450 is shown including a main contact portion 452 and an interposer portion 454. The interposer portion 454 includes a central section 456 having contact fingers 458, 460 and 462 extending from one end thereof and contact fingers 470, 472 and 474 extending from the opposite end thereof. As shown in FIG. 17, contact finger members 458 and 462 are receivable on one side of main contact portion 452 with the intermediate contact finger 460 receivable on the opposite side of main contact portion 452. It should be appreciated then that the interposer portion 454 can be movable laterally to receive the tab contact portion 480 such that contact fingers 470, 474 are receivable on one side of tab contact 480, and contact finger 472 is receivable on the opposite side of the contact tab 480.

What is claimed is:

1. An electrical contact for electrical connection with a mating contact, the electrical contact having a base contact portion having a conductor contacting section, and an independent interposer contact portion, said interposer contact portion being electrically connected to said base contact portion at an interface, said base contact portion and said interposer contact portion being laterally movable, independently of and relative to each other, at said interface, to align itself with the mating contact.

2. The electrical contact of claim 1, wherein the interposer contact portion comprises first contact surfaces for electrical engagement with said base contact portion, and second contact surfaces for mating engagement with the mating contact.

3. The electrical contact of claim 2, wherein said first and second contact surfaces are formed normal relative to each other.

4. The electrical contact of claim 3, wherein said interposer contact portion is defined by a U-shaped portion having first and second plate portions connected by a bight portion, where said first contact portions are formed internally of said first and second plate portions, at the end opposite said bight portion, and said second contact surfaces are formed transversely through said bight portion.

5. The electrical contact of claim 3, wherein said interposer contact portion is defined by an L-shaped portion having bifurcated contact portions extending in opposite legs of said L-shaped portion and extending in opposite directions.

6. The electrical contact of claim 3, wherein said interposer contact portion is defined by a blade-shaped contact having outer contact surfaces for mating contact with said mating contact portion, and a transverse slot to receive said main contact portion.

7. The electrical contact of claim 3, wherein said main contact portion is defined by a blade portion having a transverse receiving slot for receiving said mating contact portion.

8. The electrical contact of claim 7, wherein said interposer contact portion is defined by arcuate portions having surfaces in contact with said main contact portion and portions spanning said transverse receiving slot.

9. The electrical contact of claim 8, wherein said portions spanning said transverse receiving slot are positioned on opposite sides of said blade portion.

10. The electrical contact of claim 3, wherein said interposer contact has a circular cross-section.

11. The electrical contact of claim 10, wherein said interposer contact is cylindrical.

12. The electrical contact of claim 10, wherein said interposer contact has a parabolic cross-section.

13. An electrical connector for the interconnection of conductors, and for mating connection with a mating contact, the connector comprising an insulating housing having a main terminal receiving cavity, a main terminal portion received in said main terminal receiving cavity and an independent interposer contact portion electrically connected to said main terminal portion and independently slidably movable relative to said main terminal portion to align itself with the mating contact.

14. The electrical connector of claim 13, wherein said interposer contact portion comprises first contact surfaces for electrical engagement with said main terminal portion, and second contact surfaces for mating engagement with the mating contact.

15. The electrical connector of claim 13, wherein said housing includes an interposer receiving section having said interposer contact portion positioned therein.

16. The electrical connector of claim 13, wherein said interposer receiving section allows for lateral movement of said interposer contact portion within said interposer receiving section.

17. The electrical contact of claim 14, wherein said first and second contact surfaces are formed normal relative to each other.

18. The electrical contact of claim 17, wherein said interposer contact portion is defined by a U-shaped portion having first and second plate portions connected by a bight portion, where said first contact portions are formed internally of said first and second plate portions, and said second contact surfaces are formed transversely through said bight portion.

19. The electrical contact of claim 17, wherein said interposer contact portion is defined by an L-shaped portion having bifurcated contact portions extending in opposite legs and extending in opposite directions.

20. The electrical contact of claim 17, wherein said interposer contact portion is defined by a blade-shaped contact having outer contact surfaces for mating contact with the mating contact portion, and a transverse slot to receive said main contact portion.

21. The electrical contact of claim 17, wherein said main contact portion is defined by a blade portion having a transverse receiving slot for receiving said mating contact portion.

22. The electrical contact of claim 17, wherein said interposer contact portion is defined by arcuate portions having surfaces in contact with said main contact portion and portions spanning said transverse receiving slot.

23. The electrical contact of claim 22, wherein said portions spanning said transverse receiving slot are positioned on opposite sides of said blade portion.

24. The electrical contact of claim 17, wherein said interposer contact has a circular cross-section.

25. The electrical connector of claim 13, wherein said connector comprises a plurality of terminal assemblies comprised of main terminal portions and interposer portions.

26. The electrical connector of claim 25, wherein said terminal assemblies are profiled for use with power.

27. The electrical connector of claim 26, further comprising a plurality of signal contacts.

28. The electrical connector of claim 27, wherein the housing is defined as a receptacle, with said power and signal contacts aligned in a side-by-side array.

* * * * *